US011329425B2

(12) United States Patent
Wang

(10) Patent No.: US 11,329,425 B2
(45) Date of Patent: May 10, 2022

(54) SPIRAL LOCKING DEVICE

(71) Applicant: Jiangsu Enman Electronic Industry Co., Ltd., Kunshan (CN)

(72) Inventor: Chuanbao Wang, Huainan (CN)

( * ) Notice: Subject to any disclaimer, the term of this patent is extended or adjusted under 35 U.S.C. 154(b) by 0 days.

(21) Appl. No.: 17/096,133

(22) Filed: Nov. 12, 2020

(65) Prior Publication Data

US 2022/0021154 A1 Jan. 20, 2022

(30) Foreign Application Priority Data

Jul. 20, 2020 (CN) ..... 202010700002.7

(51) Int. Cl.

| | |
|---|---|
| ***H01R 13/62*** | (2006.01) |
| ***H01R 13/623*** | (2006.01) |
| ***H01R 13/58*** | (2006.01) |
| ***H01R 13/625*** | (2006.01) |

(52) U.S. Cl.

CPC ..... *H01R 13/623* (2013.01); *H01R 13/5812* (2013.01); *H01R 13/625* (2013.01)

(58) Field of Classification Search

CPC ..... H01R 13/59; H01R 13/5812

See application file for complete search history.

(56) References Cited

U.S. PATENT DOCUMENTS

| | | | | |
|---|---|---|---|---|
| 5,104,337 | A * | 4/1992 | Chow | H01R 13/58 439/470 |
| 2017/0044840 | A1* | 2/2017 | Deere | E21B 17/046 |
| 2017/0288337 | A1* | 10/2017 | Martino | H01R 13/59 |

* cited by examiner

*Primary Examiner* — Ross N Gushi

(74) *Attorney, Agent, or Firm* — Rumit Ranjit Kanakia

(57) ABSTRACT

The invention discloses a spiral locking device, comprising a spiral body, spiral fixed cap, spiral body with a buckle groove. The spiral fixing cap can be rotated and plugged onto the spiral body, and a locking portion is arranged on the spiral fixing cap.

The buckle groove comprising an obliquely arranged strip groove body, one end of the strip groove body is provided with a groove body opening, and the other end is provided with a locking structure. The invention of spiral locking device realizes the quick disassembly and assembly of cable connection, also solves the complicated and time consuming installation of spiral fastening structure, and greatly saves the installation cost.

7 Claims, 15 Drawing Sheets

SPIRAL LOCKING DEVICE

TECHNICAL FIELD

The invention relates to the technical field of cable connection device, especially relates to a spiral locking device that applicable for electrical plug connector and electrical plug connector slot.

BACKGROUND TECHNOLOGY

The electrical plug connection is formed by the interaction of electrical plug connector and electrical plug connector slot, it can connect the cable on the electrical or on the electrical device, also can works as The electrical plug connection works by the interaction of the electrical plug connector and the electrical plug connector slot. It can connect the cable to an electrical or electronic device, also it can be used as a connection between two cables.

When connecting the cable to the electrical plug connector or the electrical plug connector slot, usually an external threaded connection part is installed on the electrical plug connector or the electrical plug connector slot, and then spiral locking the wire clamping device that fixed with cable to the external thread connection. However, the existing connection structure is more complicated, and the spiral tightening time is longer, the construction efficiency is low, and the installation or disassembly of the wire clamping device is fussy, thus cause the increasing labor costs.

CONTENT OF INVENTION

In order to overcome the above-mentioned shortcomings, the object of the present invention is to provide a spiral locking device that applicable for electrical plug connector or the electrical plug connector slot, realizes the quick disassembly and assembly of cable connection, also solves the complicated and time consuming installation of spiral fastening structure, and greatly saves the installation cost.

In order to achieve the above object, the technical solution adopted by the present invention is: spiral locking device, comprising a spiral body, spiral fixed cap, wire harness mechanism; The spiral body is fixedly installed on the electrical plug connector or the electrical plug connector slot, and is provided with a buckle groove;

The spiral fixed cap is detachably nested with the wire harness mechanism and can be rotatably plugged onto the spiral body, and the spiral fixed cap is also provided with a lockable latch capable of being locked into the locking groove.

The advantage of this invention: During the installation, firstly, embedded the wire harness mechanism in the spiral fixed cap, and then rotated and plugged the spiral fixed cap into the spiral body, the quick disassembly and assembly of the spiral fixed cap and the spiral body are realized by the setting of the locking part and the locking groove thus solves the complicated and time consuming installation of spiral fastening structure, and greatly saves the installation cost.

Further, the locking groove comprising strip groove inclinedly installed along the side wall of the spiral, one end of the strip groove is provided with a groove opening formed along the edge of the spiral, and the other end is provided with a locking structure for locking the locking part.

Further, the locking structure comprising a rotary groove connected by a strip groove, at the junction of the rotary groove and strip groove, a locking point protrusion installed for locking the locking part. By the function of locking point protrusion can lock the locking part inside the rotary groove.

Further, the sloped holding surface that can abut the locking part is also installed in the rotary groove. The low point of sloped holding surface is located at the junction of rotary groove and strip groove, and the high point is located in the rotary groove.

By setting the position of the low point and the high point of the sloped holding surface, the locking part is gradually compressed when entering the rotary groove (the gap between the locking part and the slope holding surface is gradually reduced). The groove is gradually released (the gap between the locking part and the sloped holding surface is gradually increased), which makes the locking part tighter when it is locked in the rotary groove, and easier when it is unlocked.

Further, the spiral fixed cap is hollow shell structure, one end is the inlet, another end is the outlet; The locking part has been installed at the end of outlet.

Further, the shrinked arc surface from away from the inlet to near the inlet gradually shrinks radially been installed in the inner wall of the end of the spiral fixed cap that close to the inlet. It is convenient to cooperate with the wire harness mechanism by setting of the shrinked arc surface to clamp the cable.

Further, the inner wall of the end of the spiral fixed cap near the outlet is provided with a guide yielding slope, and the outer wall of the spiral body is provided with a wire guide slope that matches the guide yielding slope.

The plug connection between the spiral body and spiral fixed cap more smoothly by setting the guide yielding slope and wire guide slope.

Further, the outer wall of the spiral fixed cap is evenly distributed with several non-slip grooves which are convenient for plugging the spiral fixed cap onto the spiral body.

It is convenient for the worker to rotate the spiral fixed cap and prevent slipping during rotation by the non-slip groove.

Further, the wire harness mechanism comprising an annular base, several wire harness columns installed in a circular array way at one side of the annular base.

Inside those wire harness columns form a wire harness space for accommodating the cable, the wire harness reverse has been installed inside the wire harness column.

Further, a notch installed on the external wall of annular base, some chutes were installed outside the wire harness columns, and at least one chute should be connected with the notch. By setting the notch and chute to give a way to the locking part when embedded in the wire harness mechanism.

spiral body; 11—Arc plate; 111—Wire guide slope; 112—Counterpoint identification; 12—Strip groove; 121—Groove opening; 13—Rotary groove; 131—locking point protrusion; 14—Sloped holding surface; 2—spiral fixed cap; 21—Locking part; 22—Wire inlet; 23—Wire outlet; 25—Shrinked arc surface; 26—Guide yielding slope; 27—Non-slip groove; 28—Clamping column position identification; 3—Wire harness mechanism; 31—Annular base; 311—Notch; 32—Wire harness columns; 321—Wire harness reverse; 322—Chute; 4—Electrical plug connector; 5—Electrical plug connector slot.

CONCRETE IMPLEMENTATION METHOD

The following is a detailed description of the preferred embodiment of the invention in combination with the figures, so that the advantages and features of the invention can be more easily understood by technicians in this line, then to make a clearer definition of the protection scope of this invention.

EMBODIMENT

Figure 1:
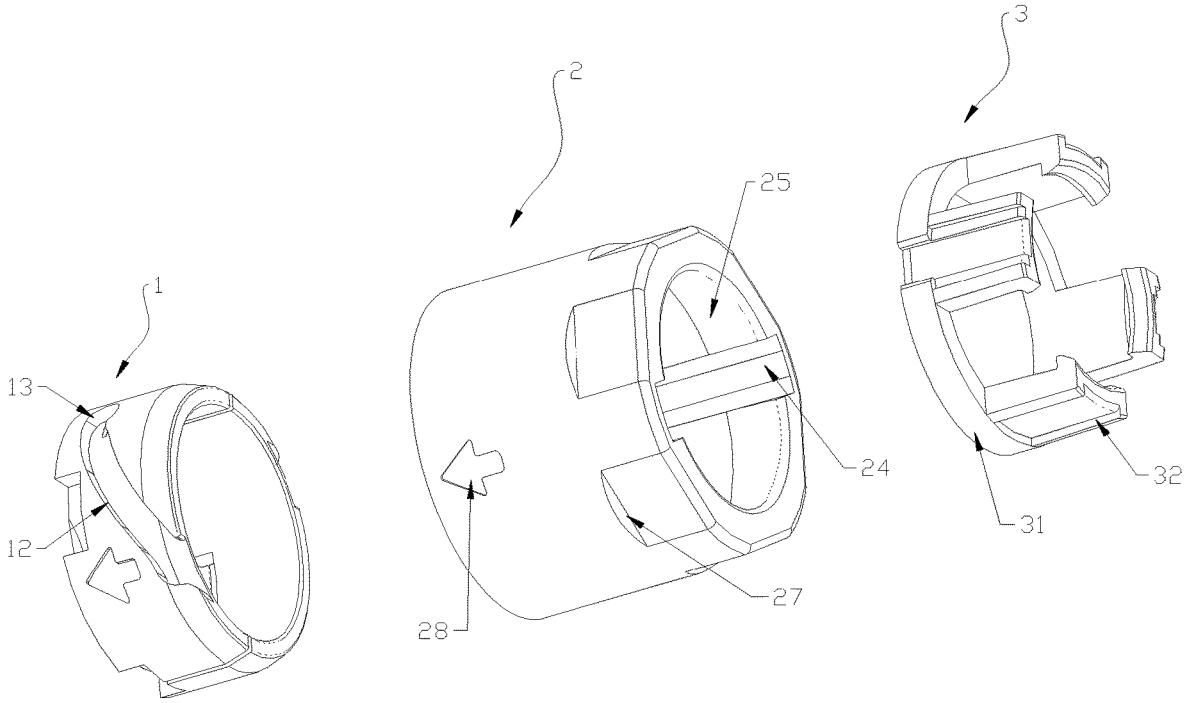
FIG. 1 is an exploded diagram of embodiment of the present invention.

As shown in FIG. 1, spiral locking device, comprising a spiral body (1), spiral fixed cap (2), wire harness mechanism (3). The spiral body (1) is fixedly installed on the electrical plug connector (4) or the electrical plug connector slot (5), and is provided with a buckle groove. The spiral fixed cap (2) is detachably nested with the wire harness mechanism (3) and can be rotatably plugged onto the spiral body (1). The spiral fixed cap (2) is also provided with a lockable latch capable of being locked into the locking groove (21).

Figure 2:
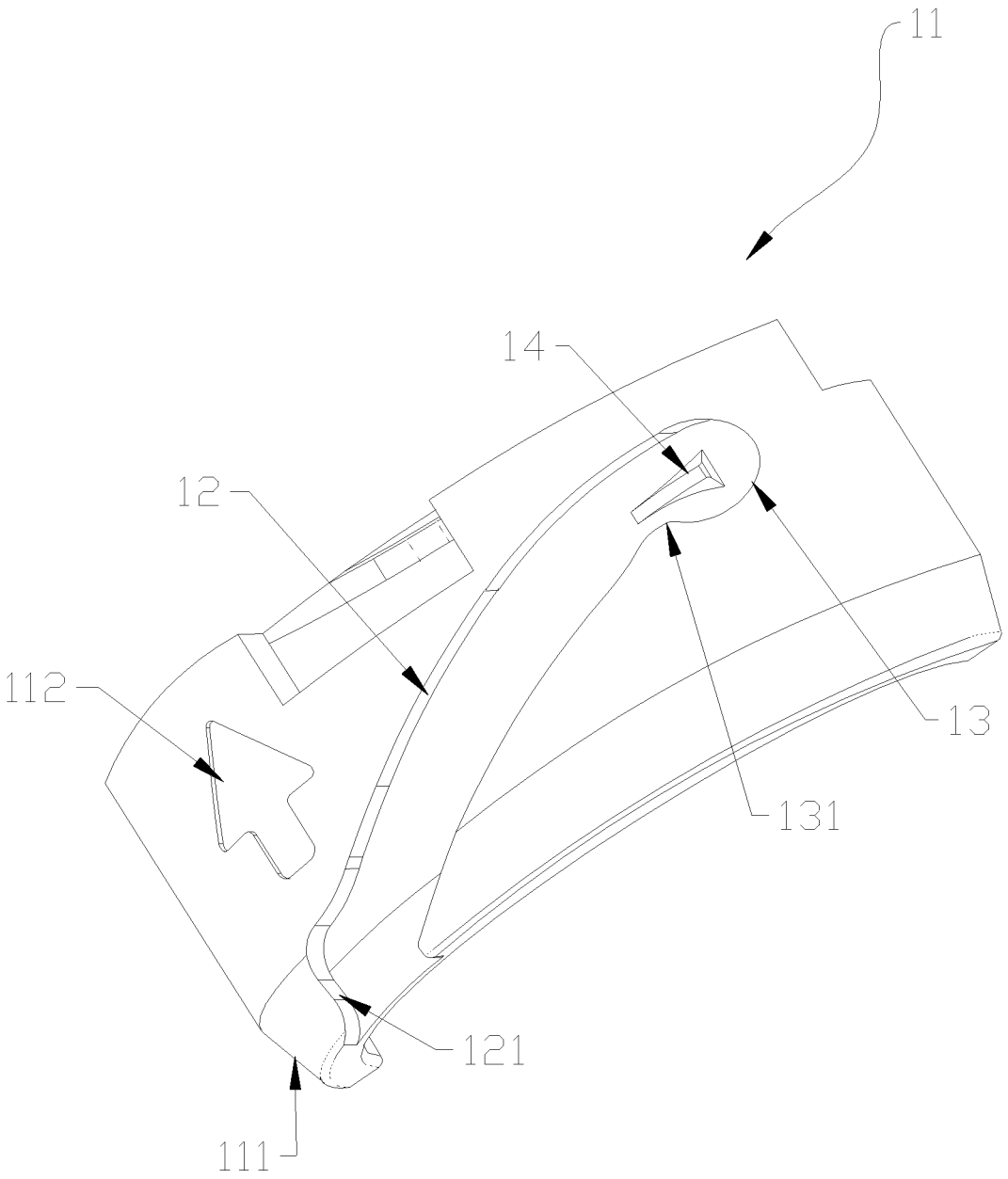
FIG. 2 is a schematic diagram of embodiment of arc plate of the present invention.

In the embodiment, as shown in FIG. 1-2, the spiral body (1) is combined by a pair of symmetrically installed and surrounded into a ring structure arc plate (11). One end of the arc plate (11) fixed on electrical plug connector (4) or electrical plug connector slot (5), the other end of the arc plate (11) is for spiral fixed cap (2) to plug into.

There are 2 buckle grooves all installed on the pair of the arc plate (11). Specifically, the the buckle groove comprising strip groove (12) inclinedly installed along the side wall of the arc plate (11), one end of the strip groove (12) is provided with a groove opening (121) formed along the edge of the spiral (12), and the other end is provided with a locking structure for locking the locking part (21).

In order to facilitate the locking part (21) to enter the strip groove body (12) along the groove body opening (121), the R angle of the groove body opening (121) set to be greater than 90 degrees.

The end of the arc plate (11) near the groove body opening (121) is also provided with an wire guide slope (111) for the plug spiral fixed cap (2).

The locking structure comprising a rotary groove (13) connected by a strip groove (12), at the junction of the rotary groove (13) and strip groove (12), a locking point protrusion (131) installed for locking the locking part (21).

A sloped holding surface (14) that can abut the locking part (21) is also installed in the rotary groove (13); The low point of sloped holding surface is located at the junction of rotary groove (13) and strip groove (12), and the high point is located in the rotary groove (13).

During installation, the locking part (21) enters the strip groove (12) through the groove body opening (121), and rotates the spiral fixed cap along the inclination direction of the strip groove (12), then the locking part (21) moves along the strip groove (12) and enters into the rotary groove (13) through locking point protrusion (131), due to the limitation of limitation of the locking point protrusion (131), the locking part (21) can be locked in the rotary groove (13); when need to disassemble the locking part (21), just turn the spiral fixed cap (2) in the reverse direction, the locking part (21) along the locking point protrusion (131), strip groove (12), groove body opening (121) spiraled out of the buckle groove to realize the disassembly of the spiral fixed cap and the spiral body.

In the process of locking part (21) entering the rotary groove (13) through locking point protrusion (131), The arrangement of sloped holding surface (14) enables the locking part (21) to abut against the sloped holding surface (14), and by setting the position of the low point and the high point of the sloped holding surface (14), the locking part (21) is gradually compressed when entering the rotary groove (13) (the gap between the locking part and the slope holding surface is gradually reduced), which makes the locking part tighter when it is locked in the rotary groove, and easier when it is unlocked.

In addition, in order to make the locking part (21) rotate in or out of the strip groove body (12) more smoothly, both sides of the strip groove (12) are polished to ensure its smoothness.

Figure 3:
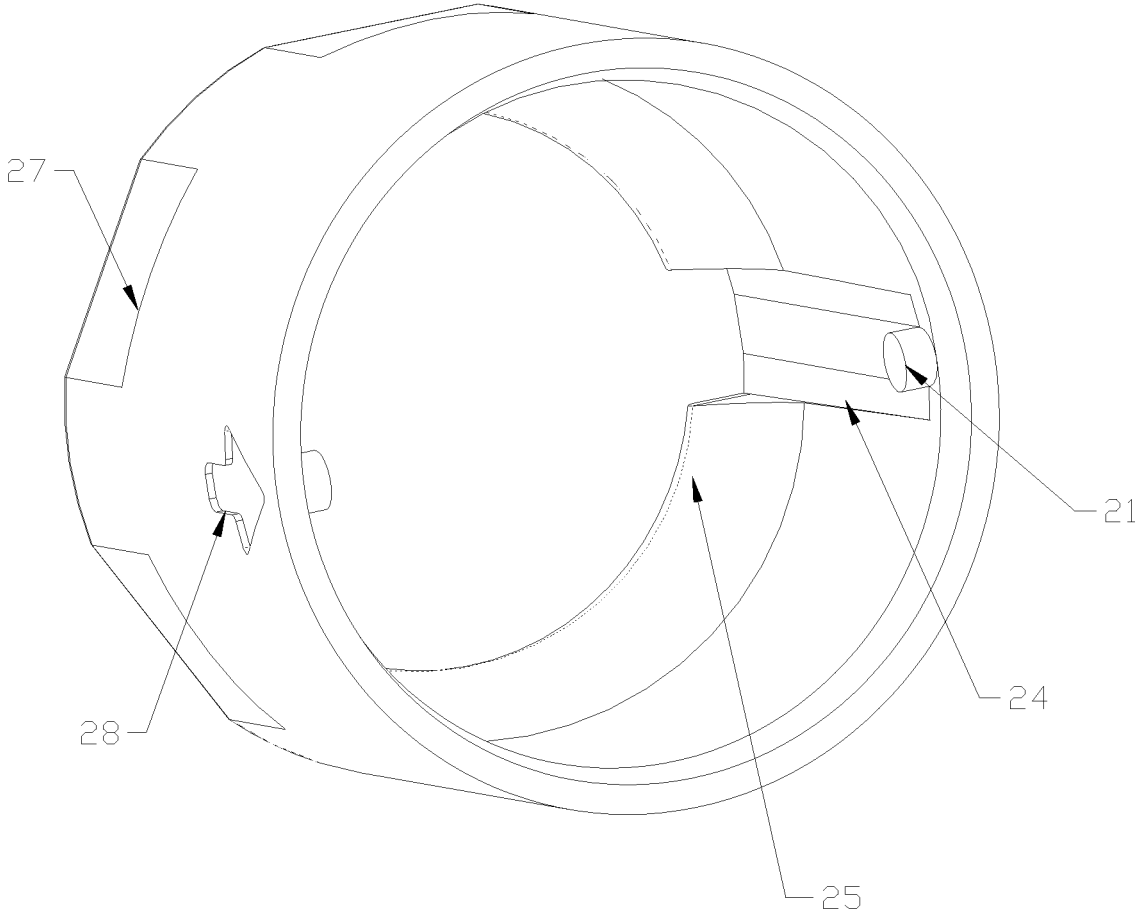
FIG. 3 is a schematic diagram of embodiment of spiral fixed cap of the present invention.
Figure 4:
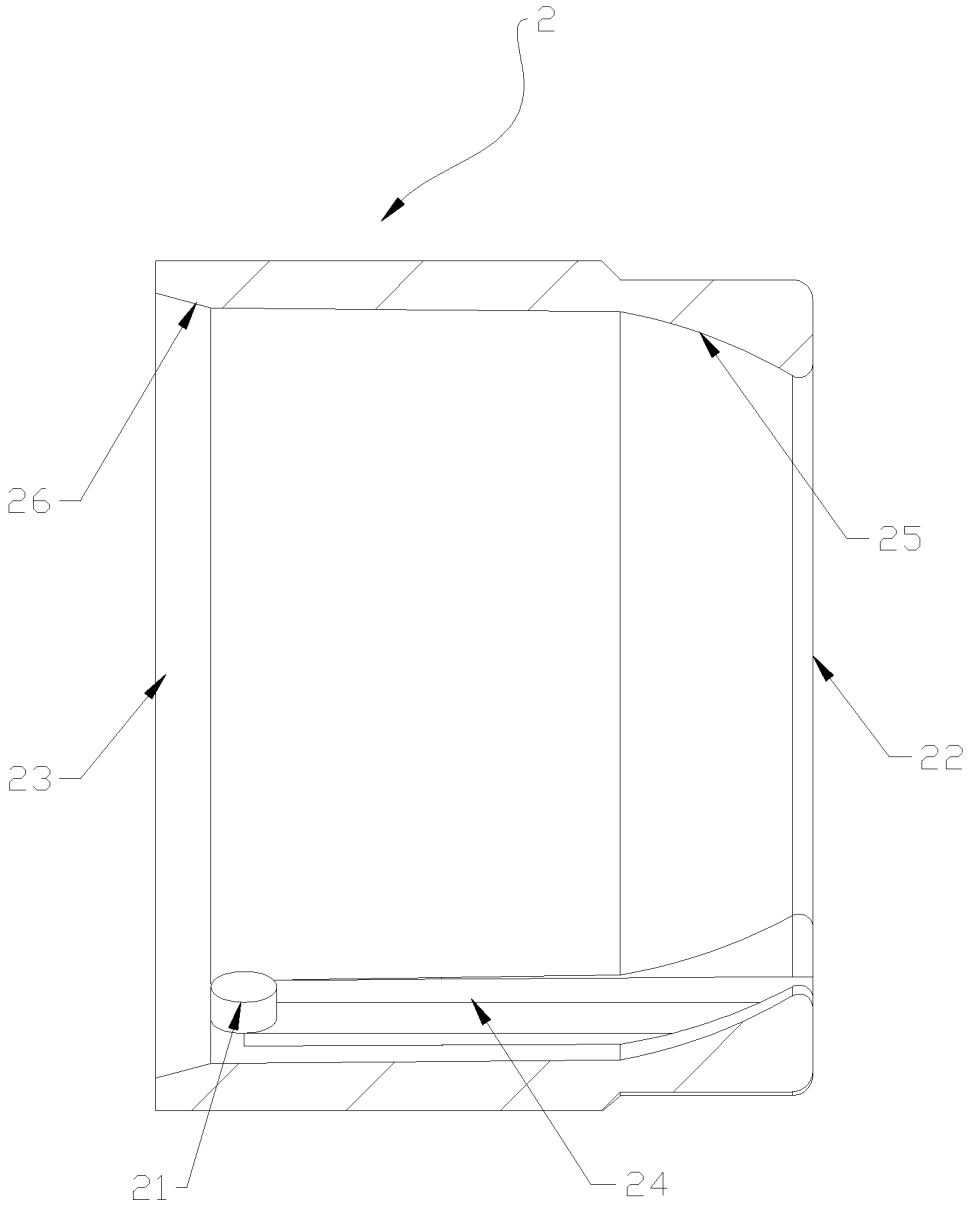
FIG. 4 is a cutting diagram of embodiment of spiral fixed cap of the present invention.

In the embodiment, as shown in FIG. 3-4, the spiral fixed cap (2) is hollow shell structure, one end is the wire inlet (22), another end is the wire outlet (23); The locking part has been symmetrically installed at the end of outlet, the locking part (21) is the cylindrical structure clamping column.

A shrinked arc surface (25) from away from the wire inlet (22) to near the wire inlet (22) gradually shrinks radially been installed in the inner wall of the end of the spiral fixed cap (2) that close to the wire inlet (22).

The inner wall of the end of the spiral fixed cap (2) near the wire outlet (23) is provided with a guide yielding slope (26), the outer wall of the spiral fixed cap (2) is evenly distributed with several non-slip grooves (27) which are convenient for plugging the spiral fixed cap (2) onto the spiral body (1), It is convenient to cooperate with the wire harness mechanism (3) by setting of the shrinked arc surface (25) to clamp the cable. The plug connection between the spiral body (1) and spiral fixed cap (2) more smoothly by setting the guide yielding slope (26) and wire guide slope (111).

It is convenient for the worker to rotate the spiral fixed cap and prevent slipping during rotation by the non-slip groove.

The outer wall of one end of the spiral fixed cap (2) near the wire outlet (23) is provided with a clamping column position identification (28) for identifying the position of clamping column, the arc plate (11) is provided with a counterpart identification (112) for aligning the position of clamping column. The counterpart identification (112) is located directly above the groove opening (121). When spiral fixed cap (2) is plugged into the spiral body (1), the clamping column can enter the groove opening accurately by aligning the clamping column position identification and counterpart identification.

Figure 5:
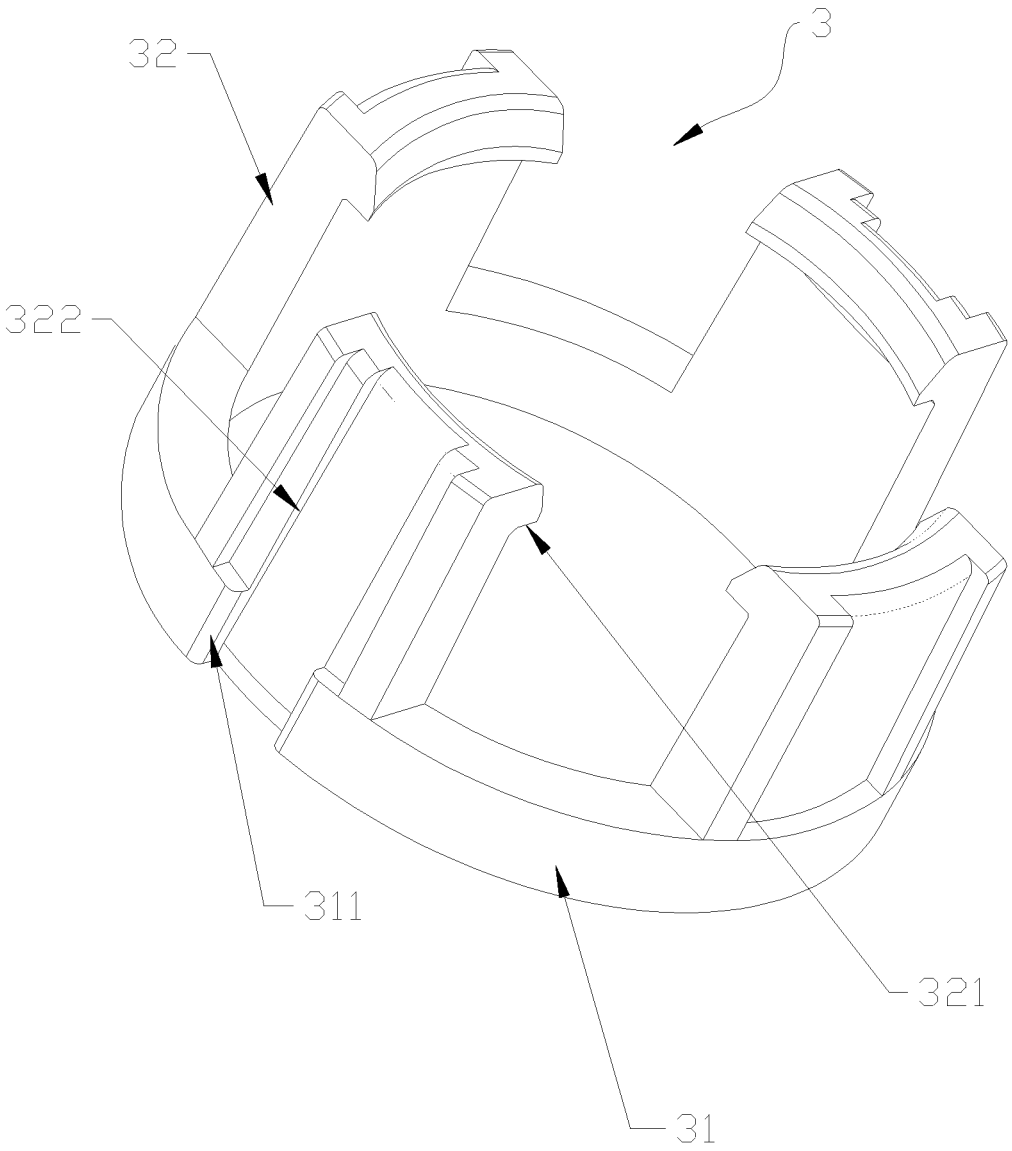
FIG. 5 is a schematic diagram of embodiment of wire harness mechanism of the present invention.

In the embodiment, as shown in FIG. 5, the wire harness mechanism (3) comprising an annular base (31), 4 pieces wire harness column (32) installed in a circular array way at one side of the annular base. Inside those wire harness columns (32) form a wire harness space for accommodating the cable, the end of the wire harness column away from the annular bottom bracket is a free end, which can be contracted or opened under the external force, the wire harness reverse (321) has been installed inside the free end.

When nesting the wire harness mechanism (3), insert the free ends of the 4 wire harness columns embed the spiral fixed cap from the end of spiral fixed cap outlet, and force the wire harness column (32) move to the wire inlet (22), when the free end of wire harness column (32) move to shrinked arc surface (25), due to the function of shrinked arc surface, the free end of wire harness column (32) can be inwardly contracted, which causes the wire harness space close to the middle to clamp the cable.

In the process of nesting, in order to avoid the clamping column, the outer wall of annular base (31) is provided with a pair of notches (311) for clamping column to slide, and the outer wall of wire harness column (32) is provided with a chute (322) for clamping column to slide. Among them, the chutes (322) on the two wire harness columns (32) communicate with the notches (311) in a one-to-one correspondence, so as to form a channel for the clamping column during the nesting process.

The Assembly Process of this Embodiment is as Follows:

First, insert the free end of the wire harness column (32) into the spiral fixed cap (2) from the end of spiral fixed cap wire outlet (23), and align the channel with the clamping column; force the wire harness mechanism (3) to move toward the wire inlet (22), and the clamping column can move along the channel till the annular base (31) completely enters the spiral fixed cap (2), and the clamping column moves out of the channel; Rotate the annular base (31), and make it rotates a certain angle along the spiral fixed cap (2) to keep the clamping column stagger a certain distance, this operation is to prevent the wire harness mechanism (3) from moving out of the spiral fixed cap (2) in the reverse direction;

Insert one end of the spiral fixed cap (2) wire outlet (23) into a pair of arc plates (11), and make the clamping column position identification (28) on the spiral fixed cap (2) align with the counterpoint identification (112) of arc plates (11) one by one.

The clamping column can enter the strip groove (12) along the groove opening (121); rotate the spiral fixed cap (2) along the incline direction of the strip groove (12), so that the clamping column can move along the strip groove (12).

The arc plate (11) can abut against the annular base (31) and push it to move in the direction of the wire inlet (22); as the clamping column moves in the strip groove (12), it can enter the rotary groove (13) through locking point protrusion (131), and the free end of wire harness column (32) can move to shrinked arc surface (25), due to the function of shrinked arc surface (25), the free end of wire harness column (32) can be inwardly contracted, which causes the wire harness space close to the middle to clamp the cable; When the clamping column is locked in the rotary groove (13), the free end of the wire harness column (32) moves to be aligned with the direction of wire inlet (22), the spiral locking device is assembled.

Figure 6:
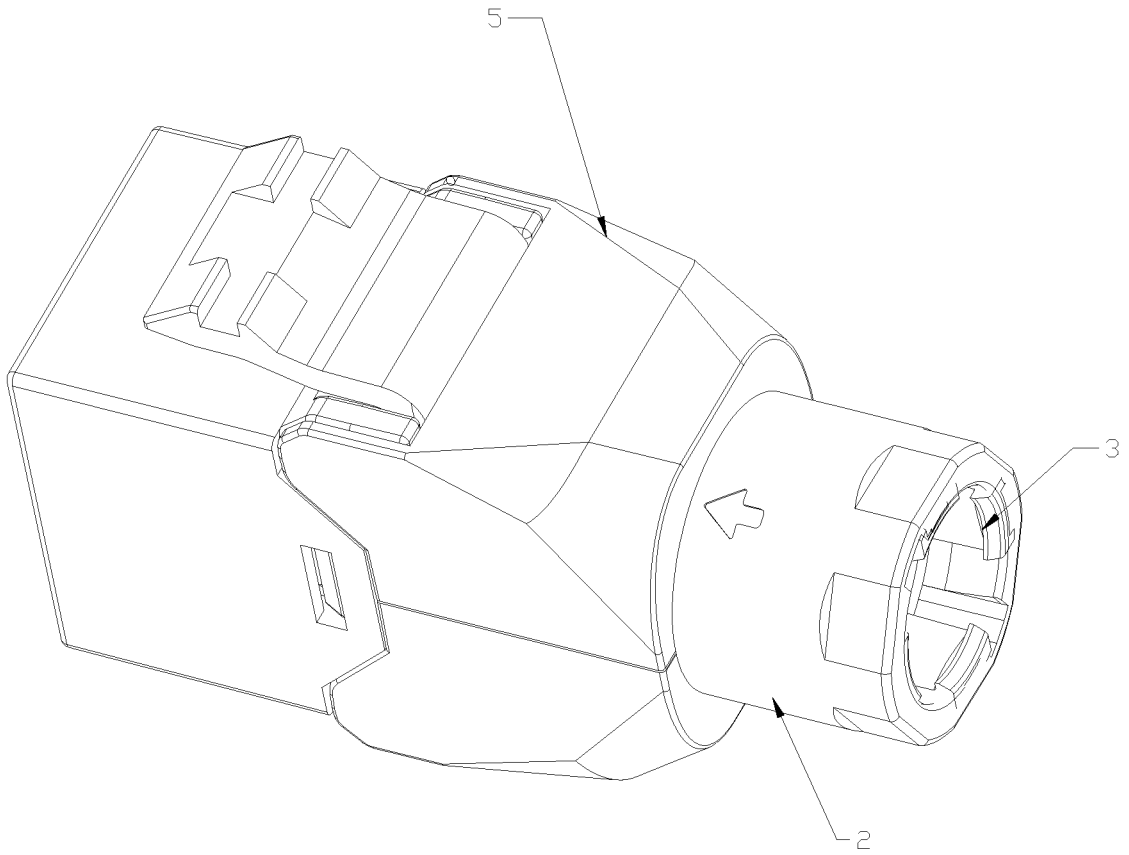
FIG. 6 is a schematic diagram of embodiment of spiral locking device assembly the electrical plug connector slot in 180 degrees of the present invention.
Figure 7:
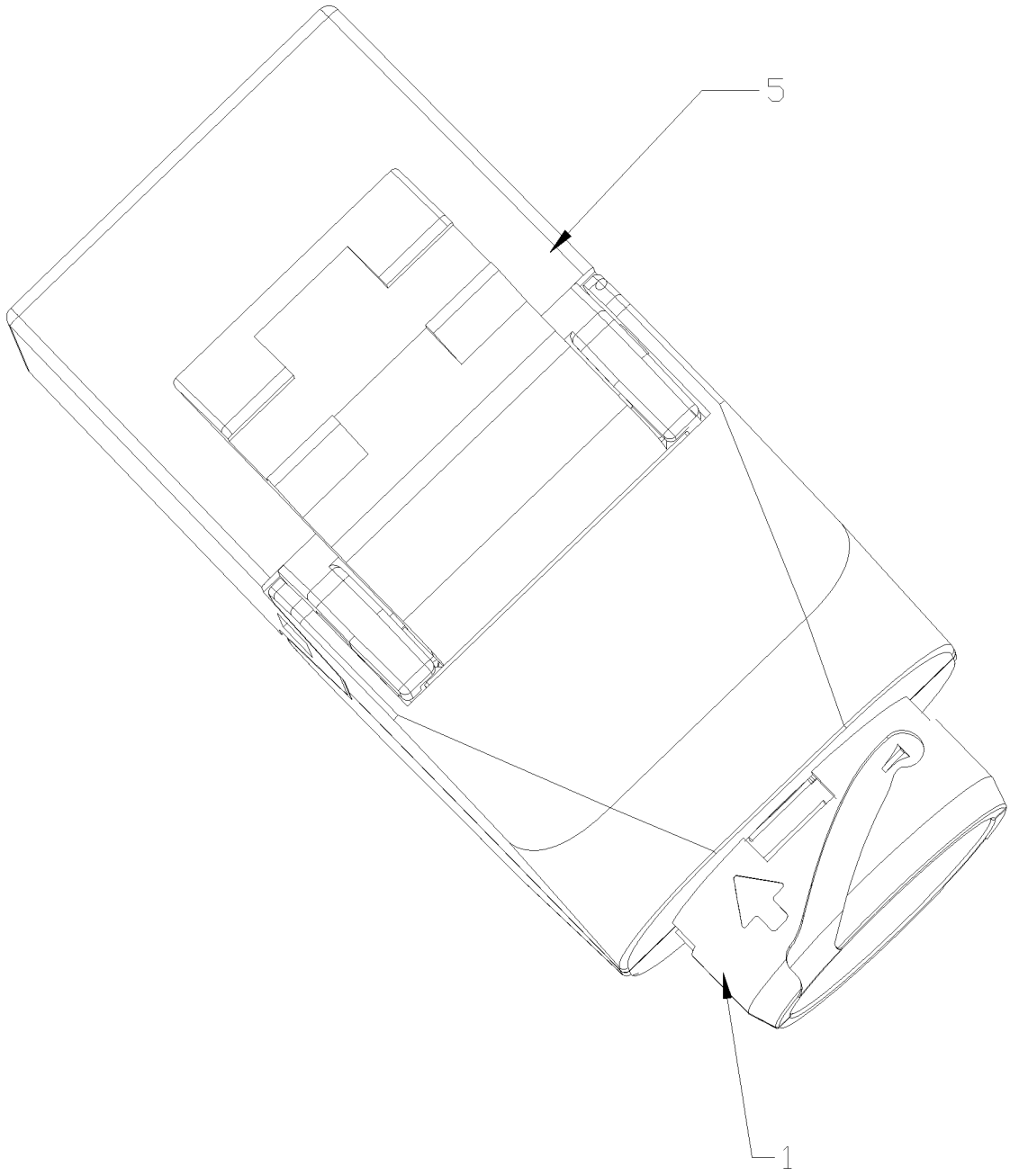
FIG. 7 is a schematic diagram of embodiment of spiral locking device assembly the electrical plug connector slot in 180 degrees of the present invention.
Figure 8:
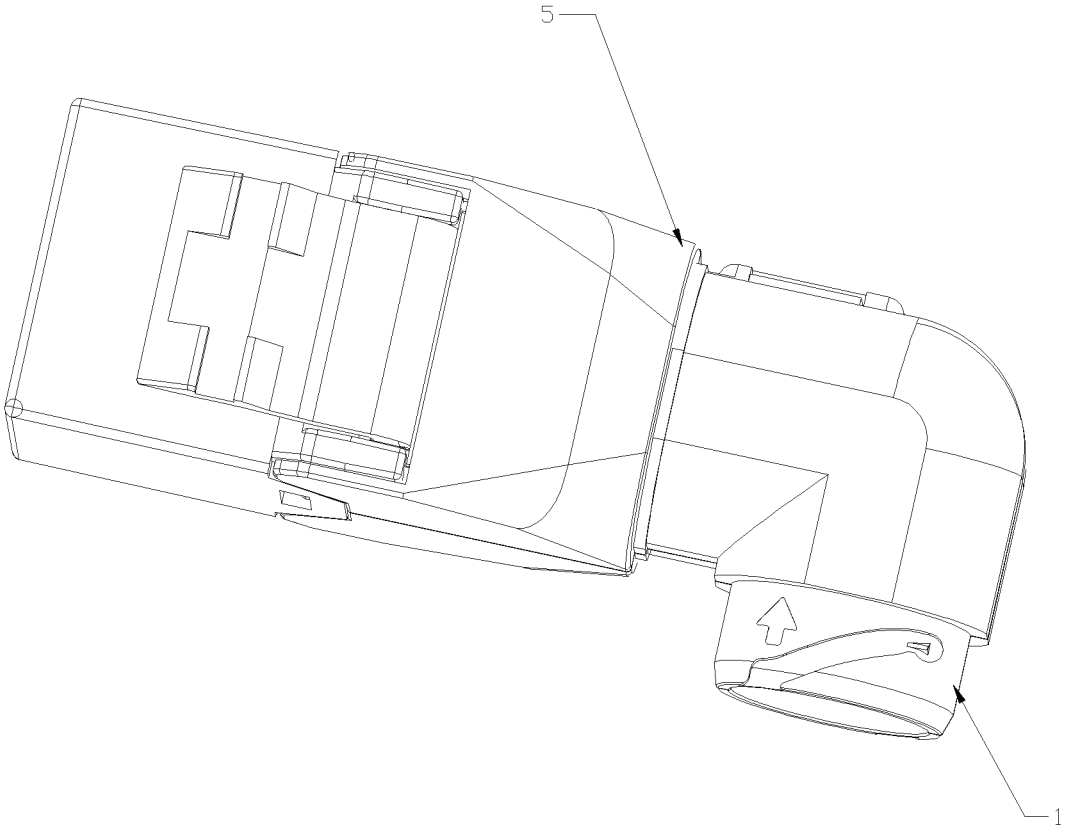
FIG. 8 is a schematic diagram of embodiment of spiral locking device assembly the electrical plug connector slot in 90 degrees of the present invention.
Figure 9:
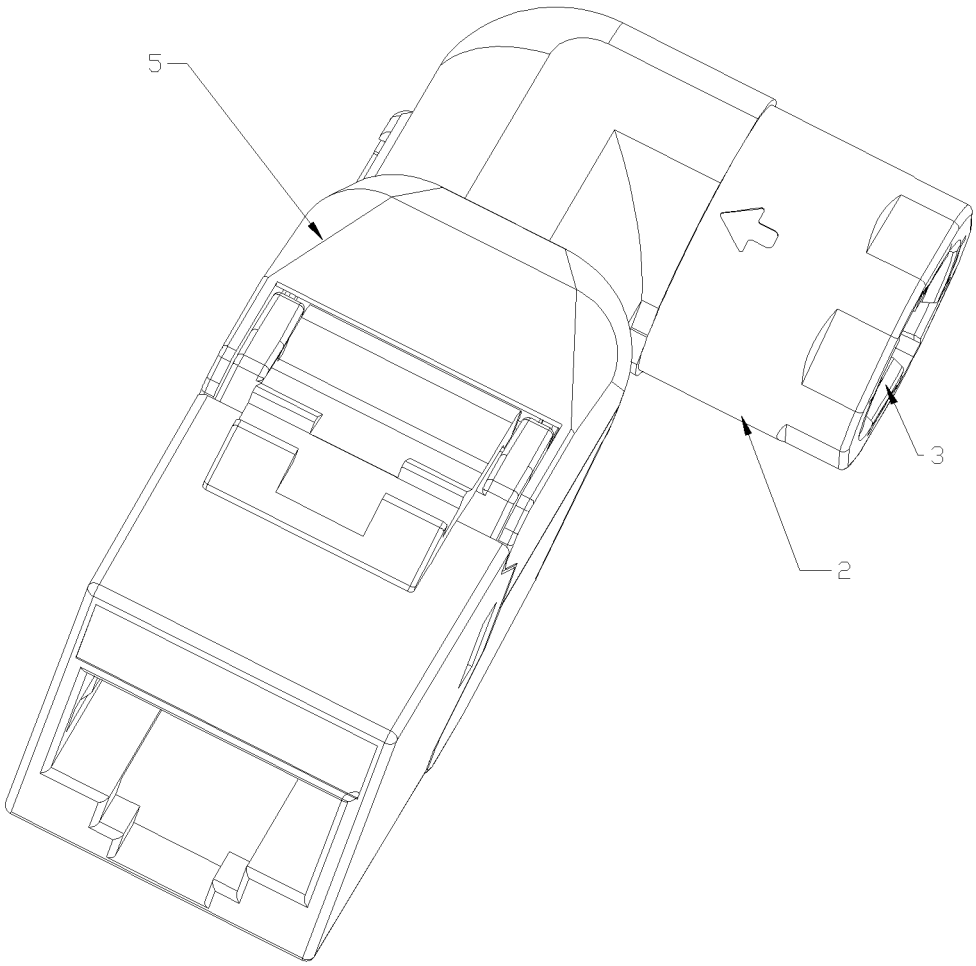
FIG. 9 is a schematic diagram of embodiment of spiral locking device assembly the electrical plug connector slot in 90 degrees of the present invention.
Figure 10:
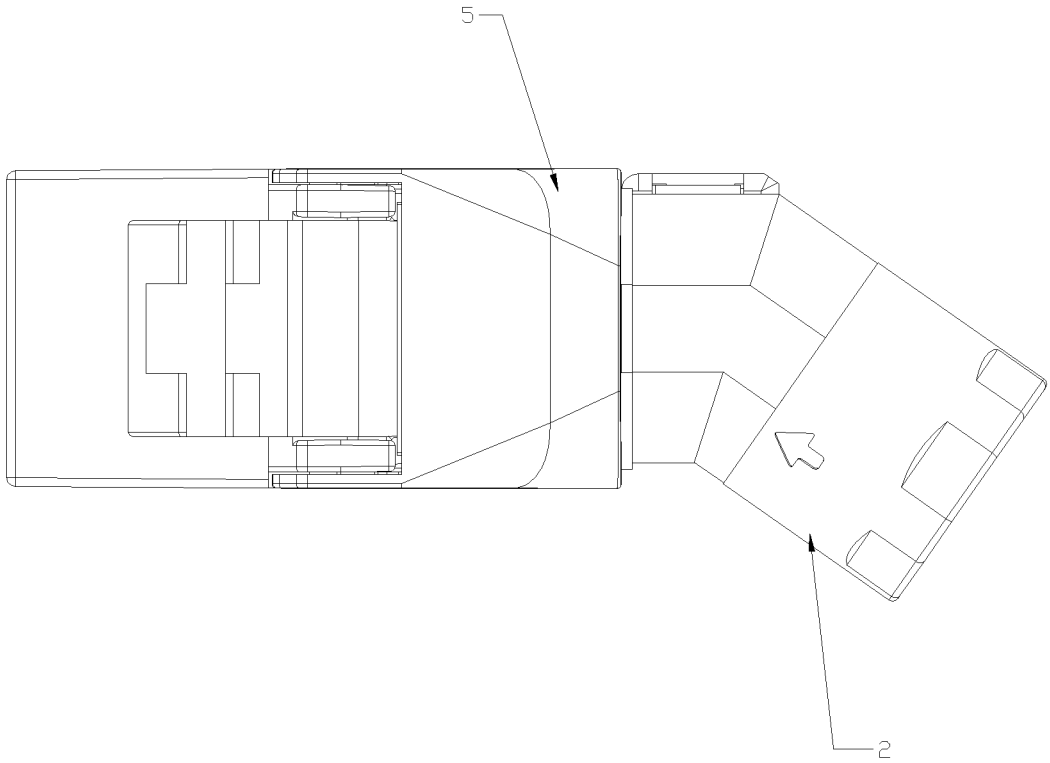
FIG. 10 is a schematic diagram of embodiment of spiral locking device assembly the electrical plug connector slot in 45 degrees of the present invention.
Figure 11:
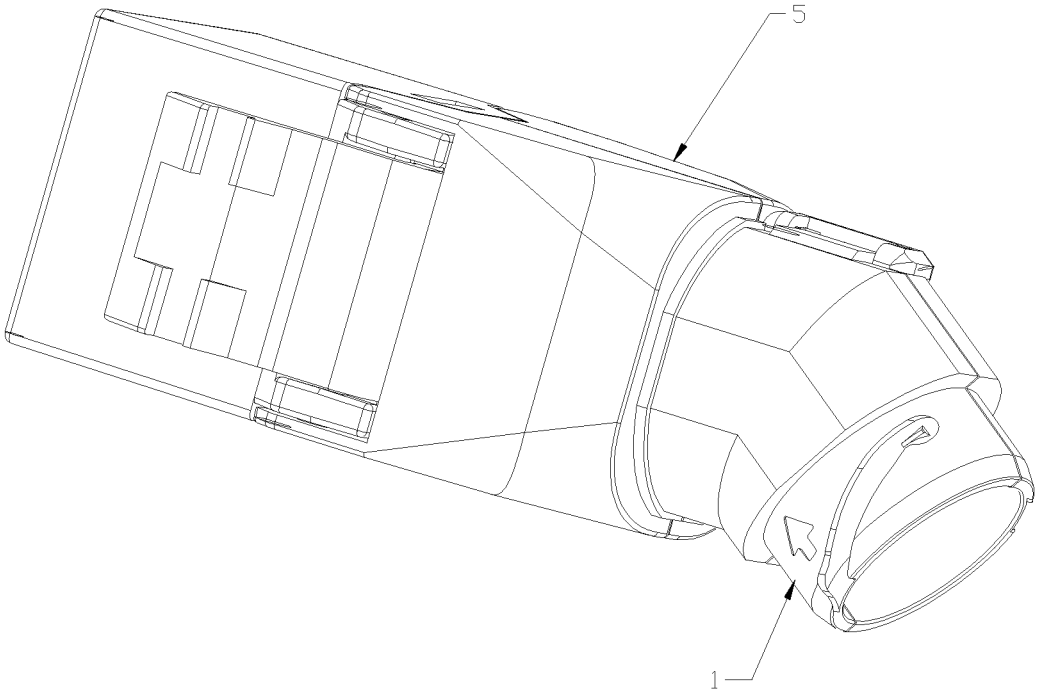
FIG. 11 is a schematic diagram of embodiment of spiral locking device assembly the electrical plug connector slot in 45 degrees of the present invention.
Figure 12:
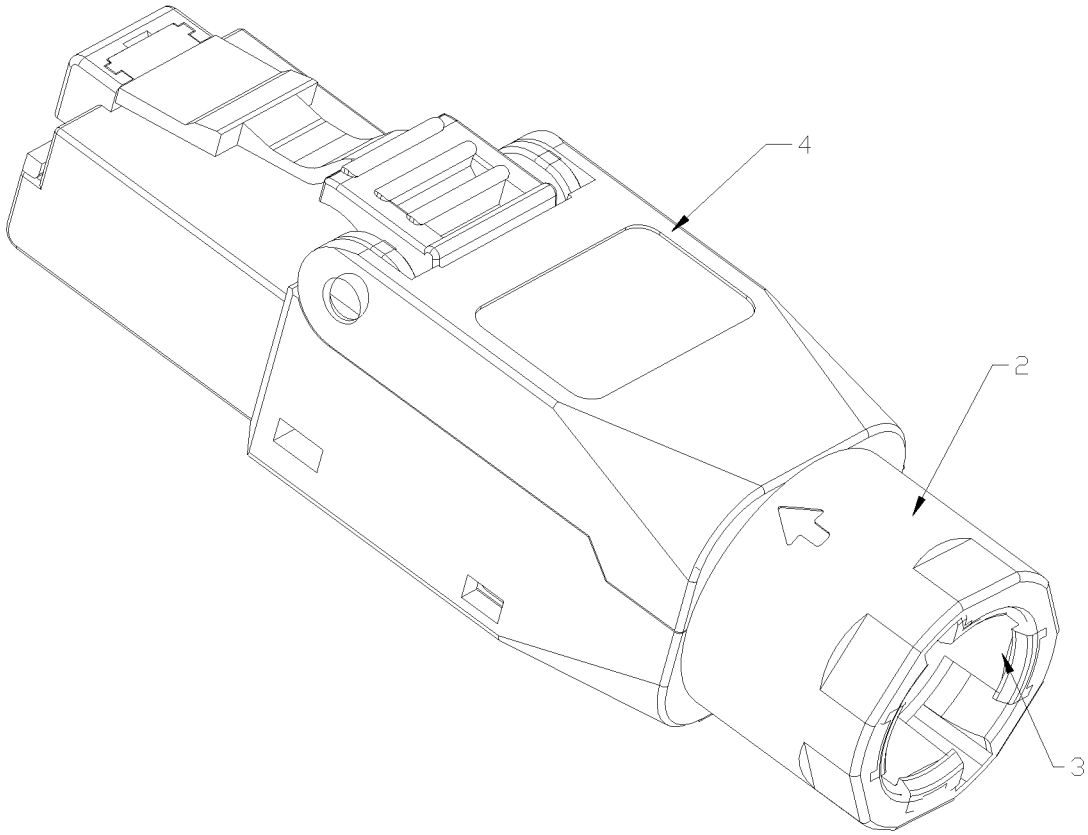
FIG. 12 is a schematic diagram of embodiment of spiral locking device assembly the electrical plug connector in 180 degrees of the present invention.
Figure 13:
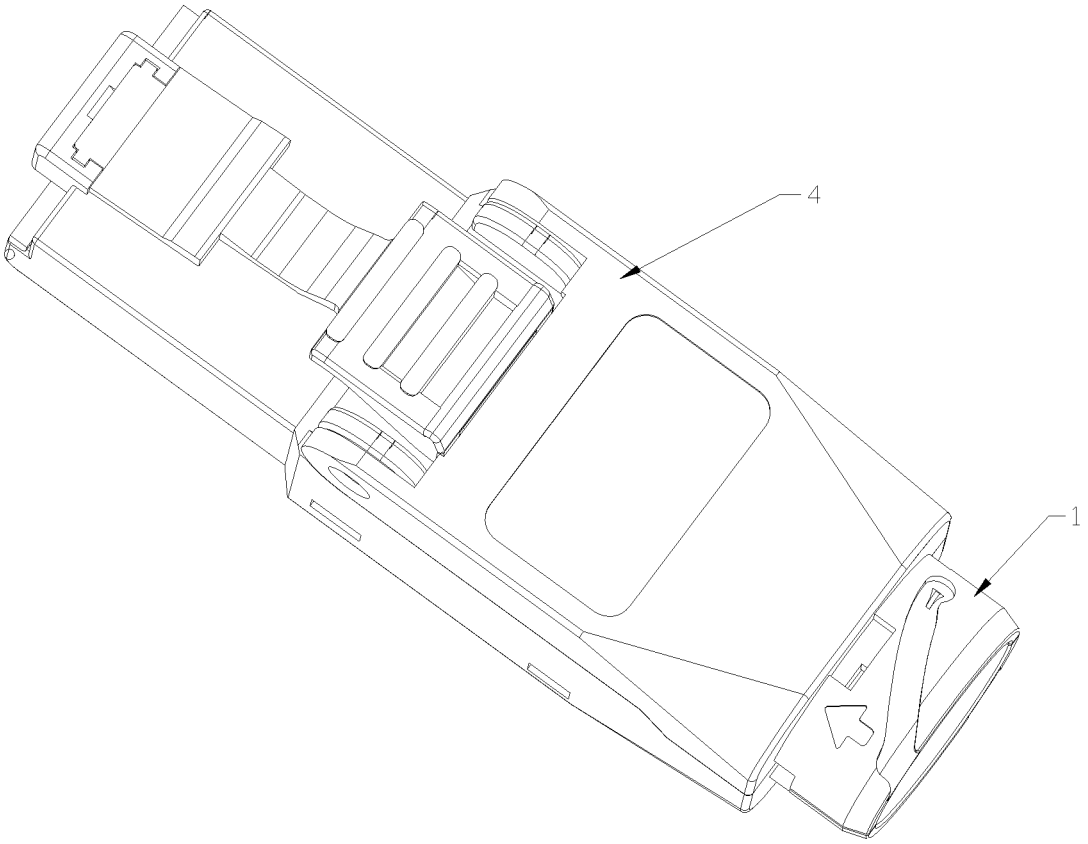
FIG. 13 is a schematic diagram of embodiment of spiral locking device assembly the electrical plug connector in 180 degrees of the present invention.
Figure 14:
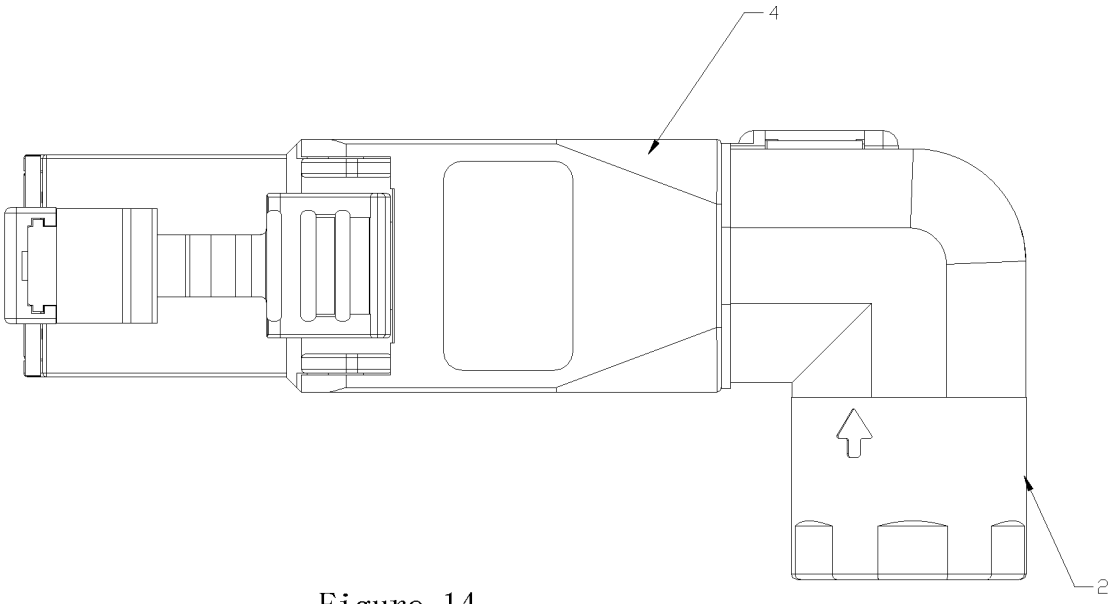
FIG. 14 is a schematic diagram of embodiment of spiral locking device assembly the electrical plug connector in 90 degrees of the present invention.
Figure 15:
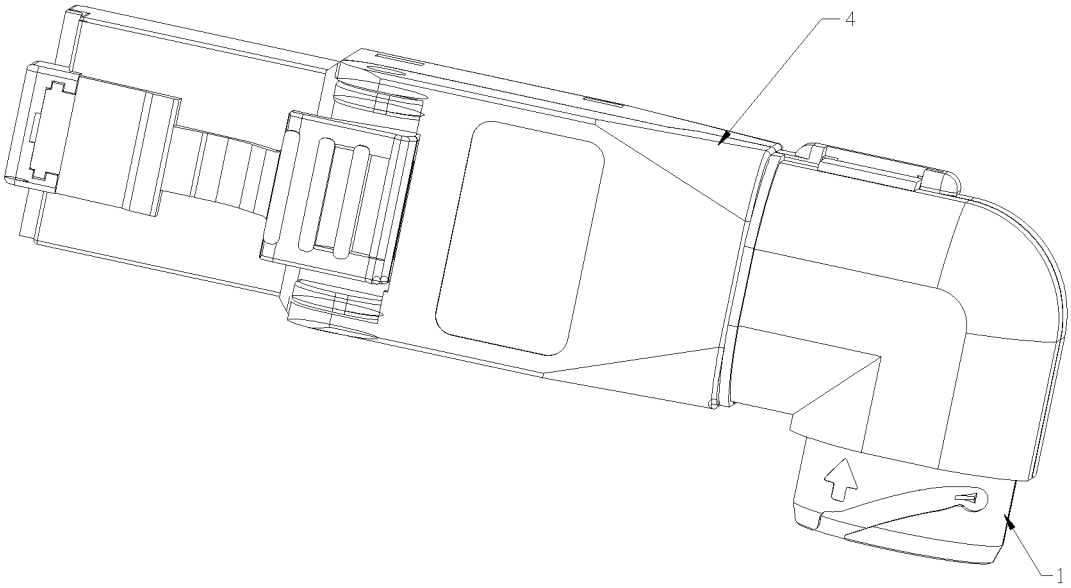
FIG. 15 is a schematic diagram of embodiment of spiral locking device assembly the electrical plug connector in 90 degrees of the present invention.
Figure 16:
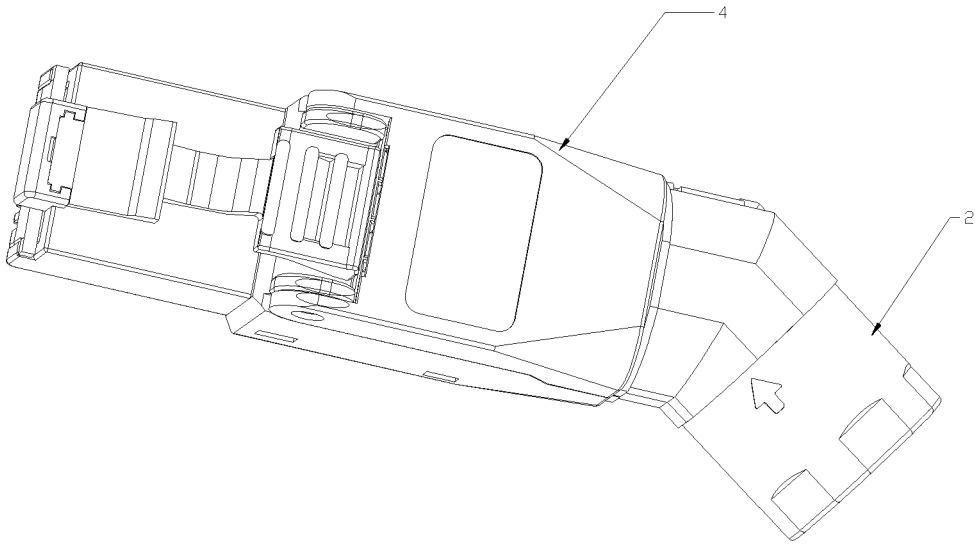
FIG. 16 is a schematic diagram of embodiment of spiral locking device assembly the electrical plug connector in 45 degrees of the present invention.
Figure 17:
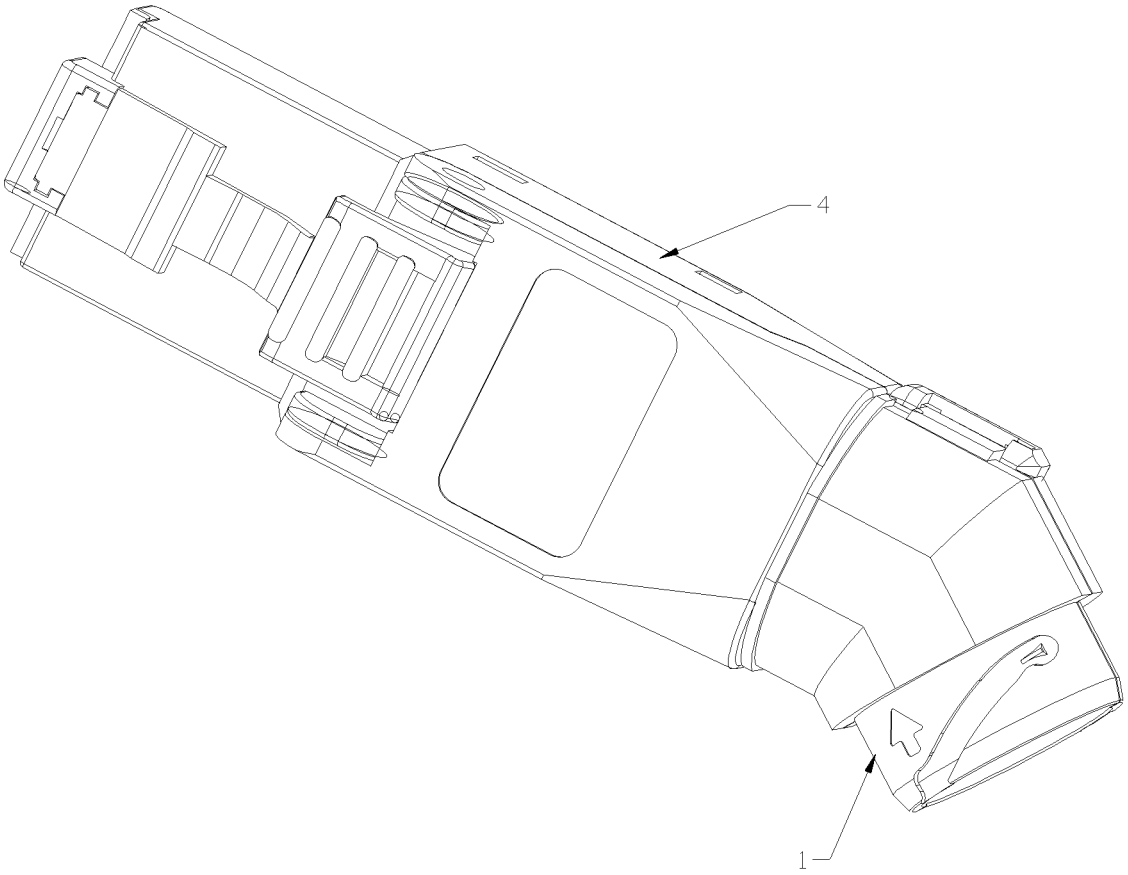
FIG. 17 is a schematic diagram of embodiment of spiral locking device assembly the electrical plug connector in 45 degrees of the present invention.

It should be noted that the electrical plug connector and the electrical plug connector slot of this embodiment are all existing technologies. According to the different directions of cable management, the existing electrical plug connector is divided into 180 degrees electrical plug connector, 90 degrees electrical plug connector, 45 degrees electrical plug connector, and existing electrical plug connector slot is divided into 180 degrees electrical plug connector slot, 90 degrees electrical plug connector slot, 45 degrees electrical plug connector slot, the FIG. 6 and FIG. 7 has shown the assembly structure of electrical plug connector slot in 180 degrees of the this invention, the FIG. 8 and FIG. 9 has shown the assembly structure of electrical plug connector slot in 90 degrees of the this invention; the FIG. 10 and FIG. 11 has shown the assembly structure of electrical plug connector slot in 45 degrees of the this invention; the FIG. 12 and FIG. 13 has shown the assembly structure of electrical plug connector in 180 degrees of the this invention, the FIG. 14 and FIG. 15 has shown the assembly structure of electrical plug connector in 90 degrees of the this invention; the FIG. 16 and FIG. 17 has shown the assembly structure of electrical plug connector in 45 degrees of the this invention.

The above implementation mode is only to illustrate the technical conception and characteristics of the invention, and it aims to let people familiar with this technology understand the content of the invention and implement it, and can not limit the protection scope of the invention. All equivalent changes or modifications made according to the spiritual essence of the invention shall be covered in the protection scope of the invention.

The invention claimed is:

1. A spiral locking device, comprising:

a spiral body; and a spiral fixing cap, wherein spiral body is fixedly disposed on an electrical plug connector or an electrical plug connector slot, the spiral body has a buckle groove; the spiral fixing cap can be rotated and plugged onto the spiral body, the spiral fixed cap is provided with a locking portion capable of being locked into the buckle groove, wherein the buckle groove comprises a strip groove body arranged obliquely along a side wall of the spiral body, the strip groove body has an opening disposed at one end of the strip groove body, and an other end of the strip groove body is provided with a locking structure for locking the locking portion, wherein the locking structure comprises a rotary groove communicating with the strip groove body, and a junction of the rotary groove and the strip groove body is provided with a locking point protrusion for clamping the lock portion, a sloped holding surface abuts the locking portion and is disposed in the rotary groove; a low point of the sloped holding surface is located at the junction of the rotary groove and the strip groove body, and a high point of the sloped holding surface is located in the rotary groove.

2. The spiral locking device according to claim 1, wherein the spiral fixed cap is a hollow shell structure, one end of the spiral fixed cap has a wire inlet, another end the spiral fixed cap has a wire outlet; the locking part portion is disposed at the end of the spiral fixed cap having the wire outlet.

3. The spiral locking device according to claim 2, wherein the spiral fixing cap further comprises a shrinked arc surface disposed on an inner wall of the end of the spiral fixed cap having the wire inlet and gradually shrinking radially toward the wire inlet.

4. The spiral locking device according to claim 2, wherein an inner wall of the another end of the spiral fixed cap having the wire outlet is provided with a guide yielding slope, and an outer wall of the spiral body is provided with a wire guide slope that matches the guide yielding slope.

5. The spiral locking device according to claim 2, wherein an outer wall of the spiral fixed cap is evenly distributed with a plurality of non-slip grooves for plugging the spiral fixed cap onto the spiral body.

6. The spiral locking device according to claim 2, wherein the spiral fixed cap is detachably nested on a wire harness mechanism, the wire harness mechanism comprises an annular base, and a plurality of wire harness columns disposed in a circular array way at one side of the annular base, a wire harness space is formed inside the plurality of wire harness columns for accommodating a cable; a wire harness reverse is disposed inside each of the plurality of wire harness columns.

7. The spiral locking device according to claim 6, wherein a notch is disposed on an external wall of the annular base, a chute is disposed at outside of each of the plurality of wire harness columns, and at least one chute is connected with the notch.

* * * * *